United States Patent [19]

Lin

[11] Patent Number: 4,896,981

[45] Date of Patent: Jan. 30, 1990

[54] AUTOMATIC PENCIL

[75] Inventor: Go-Sing Lin, Tainan, Taiwan

[73] Assignee: Mosu Pencil Corporation, Tainan, Taiwan

[21] Appl. No.: 215,348

[22] Filed: Jul. 5, 1988

[51] Int. Cl.[4] ..... B43K 21/02

[52] U.S. Cl. ..... 401/57; 401/85; 401/86

[58] Field of Search ..... 401/57, 65, 67, 82–84, 401/85, 94, 89, 90, 86

[56] References Cited

U.S. PATENT DOCUMENTS

| | | | |
|---|---|---|---|
| 2,076,470 | 4/1937 | Leimer | 401/65 |
| 2,358,091 | 9/1944 | Lovejoy | 401/65 |
| 3,945,733 | 3/1976 | Edel | 401/65 X |
| 4,657,421 | 4/1987 | Lin | 401/57 |

FOREIGN PATENT DOCUMENTS

| | | | |
|---|---|---|---|
| 13969 | 9/1982 | United Kingdom | 401/57 |

*Primary Examiner*—V. Millin
*Assistant Examiner*—David J. Bender
*Attorney, Agent, or Firm*—Marshall & Melhorn

[57] ABSTRACT

The present invention provides an automatic pencil which includes a coil spring sleeved around an inner tube, and a ring-shaped head portion carrying a lead pushing leg, the ring-shaped head portion being seated on an annular shoulder formed in the lower cone-shaped end of an outer casing, and the lead pushing leg begins to extend downward from the ring-shaped head portion at a location beyond the inner edge of the annular shoulder, thereby eliminating the need to provide a groove for receiving the upper side of the lead pushing leg.

5 Claims, 5 Drawing Sheets

AUTOMATIC PENCIL

BACKGROUND OF THE INVENTION

This invention relates to automatic pencils having an outer tubular casing housing an inner tube which receives a plurality of aligned sharpened leads and which has a bottom split end to clamp the bottommost lead during writing. More particularly, the invention relates to the construction of a lead pushing member and means for supporting the lead pushing member provided in the outer casing.

Various improvements have been made in the art for the performance and the simplicity of assembly of the automatic pencil. U.S. Pat. No. 4,320,982 discloses a mechanical pencil which has an outer casing with a tapered lower end whose inner side is provided with two diametrically opposed projections T to retain a bottommost coil of spring S as shown in FIGS. 1A to 1D. In the outer casing is an inner tube for holding sharpened pencil lead members. The spring S has a bottom end extending downward from the bottommost coil to form a lead pushing member S1 which is arranged to extend into the groove H of the clamping split end of the inner tube. Upon frequent upward and downward movement of the inner tube, the lead pushing member moves away from its proper location or moves out of the groove H, as shown in FIGS. 1A to 1D. This is because the spring retaining projections T support the spring at only two locations and the bottommost coil of the spring S and the lead pushing member are therefore liable to disclose. In addition, during assembly, the lead pushing member may be mislocated on one of the projections by which the lead pushing member will be pushed away from the groove H of the split end S1.

To alleviate the above disadvantage, the inventor of the present invention proposed an improvement in the construction of the outer casing which is illustrated in FIGS. 2A and 2B, in which the cone-shaped lower portion of the outer casing A is provided with an annular shoulder a1, a groove a2 and a restricted through-hole a3. The bottommost coil of the spring is seated on the shoulder a1, and the upper portion of the lead pushing member is received in the positioning groove to avoid lateral movement of the lead pushing member. However, it is found that the need to receive the lead pushing member in the groove a2 has created difficulties in the assembly of the pencil.

SUMMARY OF THE INVENTION

An object of the invention is to provide an automatic pencil with an improved construction of a lead pushing member which never moves out of its proper position during any operation mode of the pencil. In this way, the pencil can achieve a high performance level.

The present invention provides an automatic pencil which includes a coil spring sleeved around an inner tube, and a ring-shaped head portion carrying a lead pushing member, the ring-shaped head portion being seated on an annular shoulder formed in the lower cone-shaped end of an outer casing, and the lead pushing member extending from the ring-shaped head portion in the vicinity of the distal edge of the annular shoulder, thereby eliminating the need to provide a groove for receiving the upper side of the lead pushing member.

In one aspect of the invention, the coil spring and the ring-shaped head portion of the lead pushing member are made of the same piece.

In another aspect of the invention, the coil spring and the lead pushing means are separate structures.

The present exemplary preferred embodiments will be described in detail with reference to the accompanying drawings, in which:

DETAILED DESCRIPTION OF THE PREFERRED EMBODIMENT

Figure 1A:
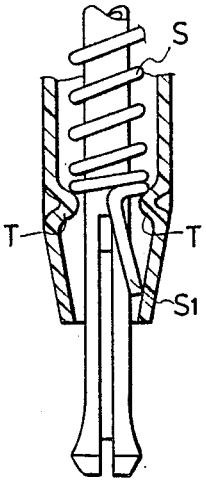
FIG. 1A PRIOR ART
FIGS. 1A to 1D show an automatic pencil in the prior art.
Figure 1B:
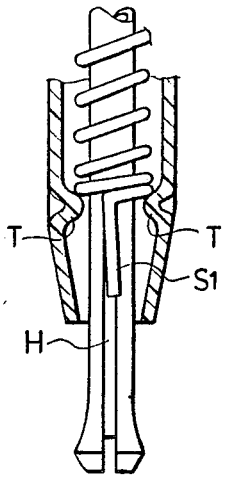
FIG. 1B PRIOR ART
Figure 1C:
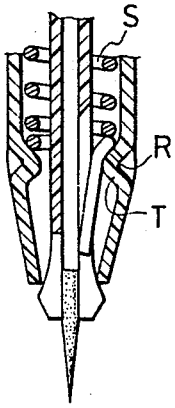
FIG. 1C PRIOR ART
Figure 1D:
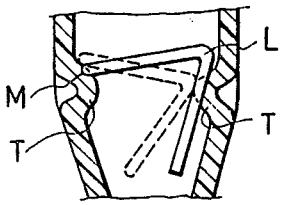
FIG. 1D PRIOR ART

For the purposes of simplified illustration, like numerals are used to represent like elements through out the drawings.

Referring to FIGS. 3 through 8, an automatic pencil is shown, including an elongated outer casing 1, an inner tube 2 extending longitudinally in the outer casing 1, a helical spring 3 sleeved on the lower portion of the inner tube, and a cap 5 slideably mounted on the outer casing and connected to the inner tube 2.

The outer casing 1 is cylindrical and includes a substantially cone-shaped bottom portion 10 having therein a restricted through-hole 11 which is smaller in cross-section than the remaining portion thereabove, an annular shoulder 101 at the top of the restricted through-hole 11 and a bell-shaped open end 12.

Pencil leads 40 are placed in the inner tube 2 with their sharpened end being directed downward. The bottom portion of the inner tube is provided with an enlarged split end 20 which has a groove 201, a longitudinal slot 22 extending upward from the groove 201, and a stepped annular projection 21 above the groove 22. The enlarged split end 20 extends out from the restricted through-hole 11 of the outer casing.

The helical spring 3 is sleeved around the bottom portion of the inner tube 2 and is kept between the stepped annular projection 21 and the annular shoulder 101. The upper end of the helical spring 3 abuts against the annular projection 21, and the lower portion of the spring 3 has a bottommost coil 30 seated on the annular shoulder 101 and a lead pushing member 302 extending downward from the bottommost coil 30. The lead pushing member 302 has a portion 301 which extends inward from the bottommost coil 30 substantially in the plane of the bottommost coil 30 in a diametric direction. The portion 301 extends to the distal edge 102 of the annular shoulder 101. From the portion 301, the lead pushing member 302 turns inward and downward at a predetermined inclined angle relative to the longitudinal axis of the inner tube 2 and is made to extend into the inner tube 2 through the slot 22. The lead pushing member 302 substantially extends to the center line of the inner tube and has an angled end 303 to abut and urge forward the rear end of the bottommost lead.

A cap 5 is mounted slideably on the top of the outer casing. The spring 3 urges the inner tube 2 so that the top of the inner tube 2 abuts against the inner side of the cap 5.

When the pencil is in an operative position, the rear end of the bottommost lead is urged by the tip of the angled end 303. When the pencil is in an inoperative position, the pencil lead is forced to retract into the inner tube 2, thereby moving the tip of the lead pushing member 302 away from the rear end of the pencil lead. When the bottommost lead is to be removed from the inner tube, the enlarged split end of the inner tube 2 is pushed forward away from the bell-shaped open end 12 of the outer casing 1 enabling the lead to be released from the groove 201 of the split end 20.

Figure 2A:
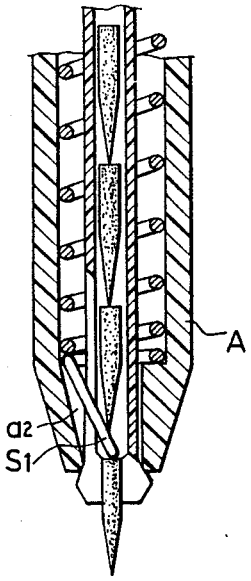
FIG. 2A PRIOR ART
FIGS. 2A to 2B show another automatic pencil in the prior art.
Figure 2B:
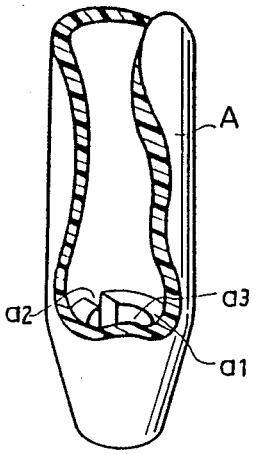
FIG. 2B PRIOR ART
Figure 3:
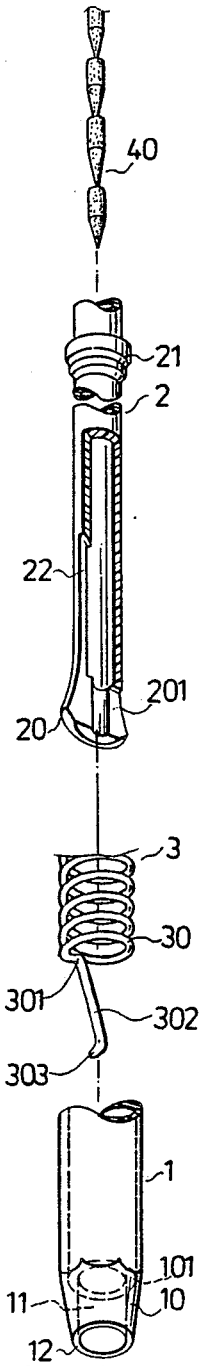
FIG. 3 is an exploded view of a lower portion of an automatic pencil incorporating the present invention.
Figure 6:
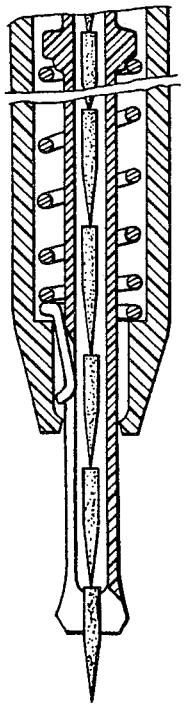
FIG. 6 is a sectional view of a portion of the pencil of FIG. 3 in which the inner tube is placed in a position ready to remove the bottommost lead.
Figure 4:
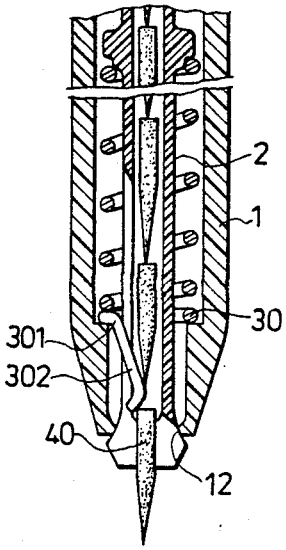
FIG. 4 is a sectional view of the portion of the automatic pencil of FIG. 3 in which the lead member is placed in an operative position.
Figure 5:
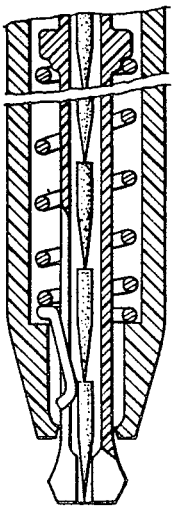
FIG. 5 is a sectional view of the portion of the pencil of FIG. 3 in which the lead is retracted into the inner tube.

The construction of the spring 30 as set forth hereinbefore can be fitted easily in the outer casing since the need to provide a groove for receiving the lead pushing member as in the case illustrated in FIGS. 2A and 2B is eliminated by providing a portion 301 which extends over the annular shoulder 101. Although the lead pushing member 302 is not positioned by any groove, it will not be dislocated because the bottommost coil 30 can be positioned on the annular shoulder without dislocation.

Figure 9:
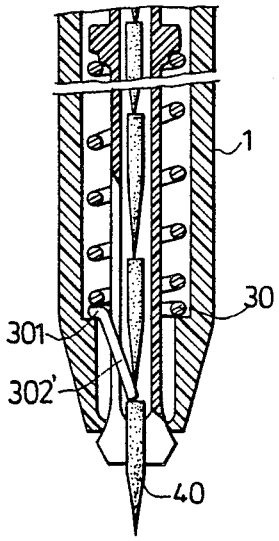
FIG. 9 is a sectional view of a portion of an automatic pencil incorporating another embodiment of the present invention.
Figure 7:
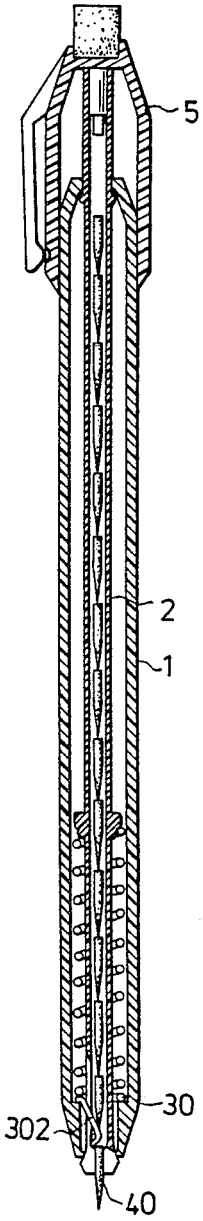
FIG. 7 is a sectional view of the whole part of the pencil of FIG. 3 in an operative position.
Figure 8:
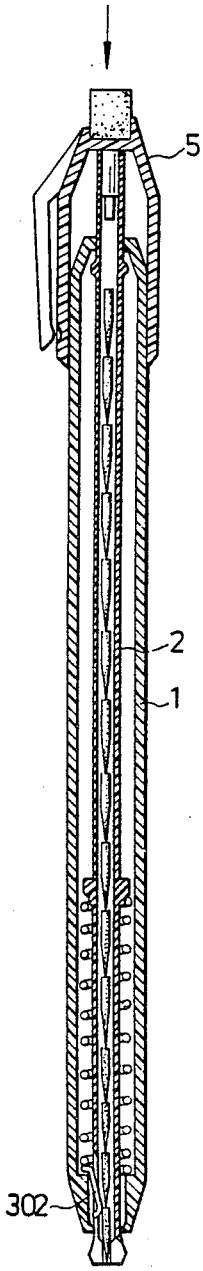
FIG. 8 is a sectional view of the whole part of the pencil of FIG. 3 in an inoperative position.

FIG. 9 shows an alternative spring 3' which is of substantially the same construction as the spring 3 except that the lead pushing leg 302' is not provided with an angled end 303 of the spring 3.

Figure 10:
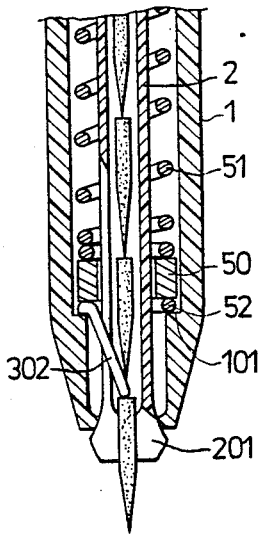
FIG. 10 is a sectional view of a portion of an automatic pencil incorporating still another embodiment of the present invention.
Figure 12:
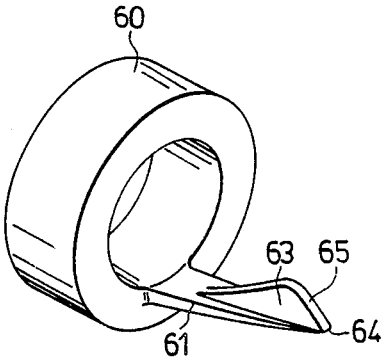
FIG. 12 is an enlarged perpspective view of the leading pushing means of the embodiment of FIG. 11.

FIG. 10 shows another spring construction of the present invention in which a coil spring 51 is sleeved around the inner tube 2 of the pencil and seated on an annular packing ring 50. The packing ring 50 is disposed on a single coil head 52 of a lead pushing member 302. The single coil head 52 is seated on the annular shoulder 101 of the casing 1'.

Figure 11:
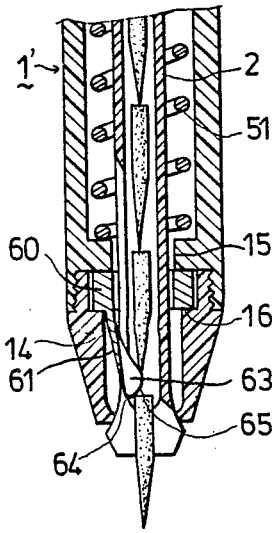
FIG. 11 is a sectional view of a portion of an automatic pencil incorporating still another embodiment of the present invention.

FIG. 11 shows still another example of the present invention wherein outer casing 1' has a coneshaped lower portion 14 which is a separate piece connected threadedly to the upper portion of the outer casing 1'. The upper portion of the casing 1' has an annular shoulder 15 to position the spring 51. The lower portion 14 also has an annular shoulder 16. The lead pushing means of this embodiment is a molded plastic piece including an annular head 60 which has an annular wall with a thickness greater than the thickness of the annular shoulder 16 so that the annular head 60 extends inside to a point beyond the inner edge of the annular shoulder 16. From this inward extending portion of the annular head 60 extends a lead pushing leg 61 which has a lower projection 63 extending inwardly. The projection 63 has a lead pushing face 64 and an inclined face 65.

With the invention thus explained, it is apparent that numerous modifications and various can be made without departing from the scope of the invention. It is therefore intended that the invention be limited only as indicated in the appended claims.

What I claim is:

1. A mechanical pencil comprising:

an elongate outer casing having a cylindrical inner wall terminating in an opening at one end, a continuous annular shoulder extending radially inwardly from the inner wall and terminating at an inner annular edge, the continuous annular shoulder disposed inwardly of the opening;

an inner tube disposed within said outer casing having an inner channel for storing a plurality of presharpened pencil leads and terminating in an enlarged end having at least a pair of cooperating slots to split the enlarged end into cooperating clamping members, and shoulder means extending outwardly of said inner tube disposed inwardly of the enlarged end;

helical spring means disposed within said outer casing and surrounding at least a portion of said inner tube, said helical spring means being operatively compressed to apply pressure between the continuous annular shoulder of said outer casing and the shoulder means of said inner tube; and pencil lead pushing means in supporting contact with the continuous annular shoulder of said outer casing and encircling said inner tube, and seated on the continuous annular shoulder of said outer casing, said lead pushing means including support means encircling said inner tube, and an associated lead pushing member depending from the support means from a point inwardly from the inner annular edge of the continuous annular shoulder of said outer casing and extending downwardly and inwardly through one of the slots in said inner tube and terminating within the inner channel of said inner tube to selectively contact an end of one of the pencil leads.

2. The mechanical pencil, according to claim 1, wherein said helical spring means and said pencil lead pushing means are affixed to one another, the support means of said pencil lead pushing means being a bottommost coil of said helical spring means.

3. The mechanical pencil, according to claim 1, wherein said helical spring means includes a packing ring disposed around said inner tube and between said helical spring means and said support means of said pencil lead pushing means.

4. The mechanical pencil, according to claim 1, wherein the support means of said pencil lead pushing means includes a ring-shaped head portion and a radial portion extending from the ring-shaped head portion inwardly in a direction normal to the axis of said inner tube and terminating at said lead pushing member.

5. A mechanical pencil comprising:

an elongate outer casing having a cylindrical inner wall terminating in an opening at one end, a continuous annular shoulder extending radially inwardly from the inner wall and terminating at an inner annular edge, the continuous annular shoulder disposed inwardly of the opening;

an inner tube disposed within said outer casing having an inner channel for storing a plurality of presharpened pencil leads and terminating in an enlarged end having at least a pair of cooperating slots to split the enlarged end into cooperating clamping members, and shoulder means extending outwardly of said inner tube disposed inwardly of the enlarged end;

helical spring means disposed within said outer casing and surrounding at least a portion of said inner tube, said helical spring means being operatively compressed to apply pressure between the continuous annular shoulder of said outer casing and the shoulder means of said inner tube; and pencil lead pushing means in supporting contact with the continuous annular shoulder of said outer casing and encircling said inner tube, and seated on the continuous annular shoulder of said outer casing, said lead pushing means including support means encircling said inner tube, and an associated lead pushing member including a lead pushing leg depending downwardly from the support means from a point inwardly from the inner annular edge of the continuous annular shoulder of said outer casing and a projection extending from the lead pushing leg inwardly through one of the slots in said inner tube and terminating within the inner tube to selectively contact an end of one of the pencil leads.

* * * * *